US006481179B2

(12) United States Patent
Zen

(10) Patent No.: US 6,481,179 B2
(45) Date of Patent: Nov. 19, 2002

(54) FRAMES FOR STEEL CLAD DOORS WITH JAMBS COMPRISING A CHANNEL WITH SPACED SIDE WALLS AND A BOTTOM WALL HAVING INTEGRALLY FORMED BRACING CONNECTED TO THE WALLS AT SPACED POINTS ALONG THE LENGTH

(75) Inventor: Vic De Zen, Woodbridge (CA)

(73) Assignee: Royal Group Technologies Limited, Woodbridge (CA)

( * ) Notice: Subject to any disclaimer, the term of this patent is extended or adjusted under 35 U.S.C. 154(b) by 57 days.

(21) Appl. No.: 09/735,473

(22) Filed: Dec. 14, 2000

(65) Prior Publication Data

US 2001/0003889 A1 Jun. 21, 2001

(30) Foreign Application Priority Data

Dec. 15, 1999 (CA) ..... 2292208

(51) Int. Cl.[7] ..... E04B 2/30

(52) U.S. Cl. ..... 52/784.13; 52/483.1; 52/656.4; 52/731.9

(58) Field of Search ..... 52/309.9, 483.1, 52/474, 784.1, 784.13, 784.15, 762, 781.3, 800.12, 800.17, 656.4, 657, 731.5, 731.6, 735.1, 731.7, 731.8, 731.9

(56) References Cited

U.S. PATENT DOCUMENTS 5,555,695 A * 9/1996 Patsy, Jr. ..... 52/222
5,839,252 A * 11/1998 Berghorn et al. ..... 52/475.1
6,253,527 B1 * 7/2001 De Zen ..... 264/343

* cited by examiner

*Primary Examiner*—Yvonne M. Horton
*Assistant Examiner*—Naoko Slack

(57) ABSTRACT

A frame for supporting steel cladding panels of steel clad doors and doors formed therewith, the frames comprising a pair of jambs connected by headers and sills, each jamb comprising a molded channel of composite plastic material having within the channel integral bracing extending between the channel side walls.

22 Claims, 3 Drawing Sheets

FRAMES FOR STEEL CLAD DOORS WITH JAMBS COMPRISING A CHANNEL WITH SPACED SIDE WALLS AND A BOTTOM WALL HAVING INTEGRALLY FORMED BRACING CONNECTED TO THE WALLS AT SPACED POINTS ALONG THE LENGTH

FIELD OF THE INVENTION

This invention relates to framing for supporting the steel panels of steel clad doors and to steel clad doors embodying such frames. More particularly, the invention is directed to such a frame which is extremely strong yet can be produced at very low cost.

BACKGROUND OF THE INVENTION

Conventionally the frames of steel clad doors are frames which define the perimeter of the door and are formed of lengths of solid wood assembled into a rectangular frame. These frames support the steel cladding with the interior of the frames being filled with insulation or the like.

Not only has wood become much more expensive but it is also subject to warping or twisting so that substitutes for wood have been sought with the result that it has been proposed that the wood frame members of frames for steel clad doors be replaced by like members of composite material as described in laid open Canadian Application Serial No. 2,210,124, laid open Jan. 10, 1998.

The present invention resides in providing an improved frame structure which will have increased strength and rigidity over previous frames and will provide an increased area of support for the steel cladding yet will be extremely economical to produce.

SUMMARY OF THE INVENTION

According to the invention, there is provided a frame structure for a steel clad door which is formed from molded composite material in which at least the jamb members of the frame are formed as channels the side walls of which provide support for the steel cladding over the height of the walls. Further, according to the invention, the interiors of the jamb channels are provided with integrally molded bracing which extends between the channel walls.

According to the preferred form of the invention, the jamb channels have grooves in their outer bottom faces adjacent each side thereof, such grooves being adapted to receive the inturned edges of the steel cladding to secure the cladding to the frame.

Further, according to the preferred form of the invention, the header and sill of the frame also constitute channels of composite material.

Again, according to a preferred embodiment of the invention, the jambs of the frames are closed at their ends with the ends being notched to form seats to receive the header and sill members.

The composite material according to the invention for use in molding the members of the frame comprise particulate material bound together with a thermoplastic binder. More particularly, according to a preferred form of the invention, the composite material comprises a mixture of wood and waste particles bound together by a thermoplastic olefin. A particular preferred composition comprising approximately 30% thermoplastic olefins which preferably are recycled thermoplastic olefins, 30% wood particles and 40% waste particles including such things, for example, as fly ash, kiln dust, sand, or particles of glass, rubber, metal, peanut shells, cloth etc.

DETAILED DESCRIPTION ACCORDING TO THE PREFERRED EMBODIMENTS OF THE PRESENT INVENTION

Figure 1:
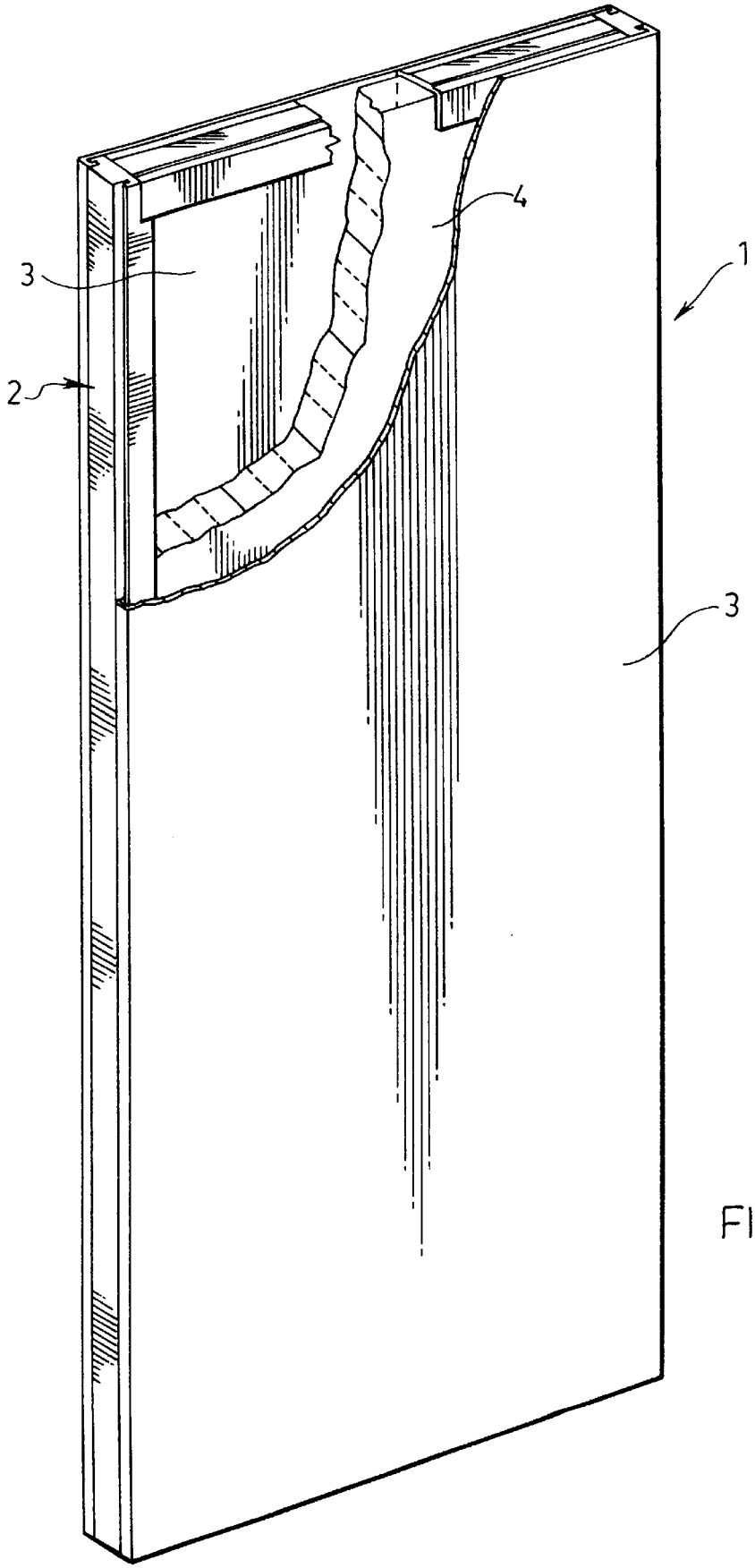
FIG. 1 is a broken away perspective view of a steel clad door having the steel cladding supported by a frame of composite material according to the invention with the interior of the door shown filled with insulating material.

With reference to FIG. 1, the steel clad door generally designated at 1 is comprised of a frame generally designated at 2 supporting steel cladding panels 3 with the interior of the frame 2 being filled with insulation 4 which may, for example, be insulation such as polyurethane foamed into the interior of the frame after the door has been assembled.

Figure 2:
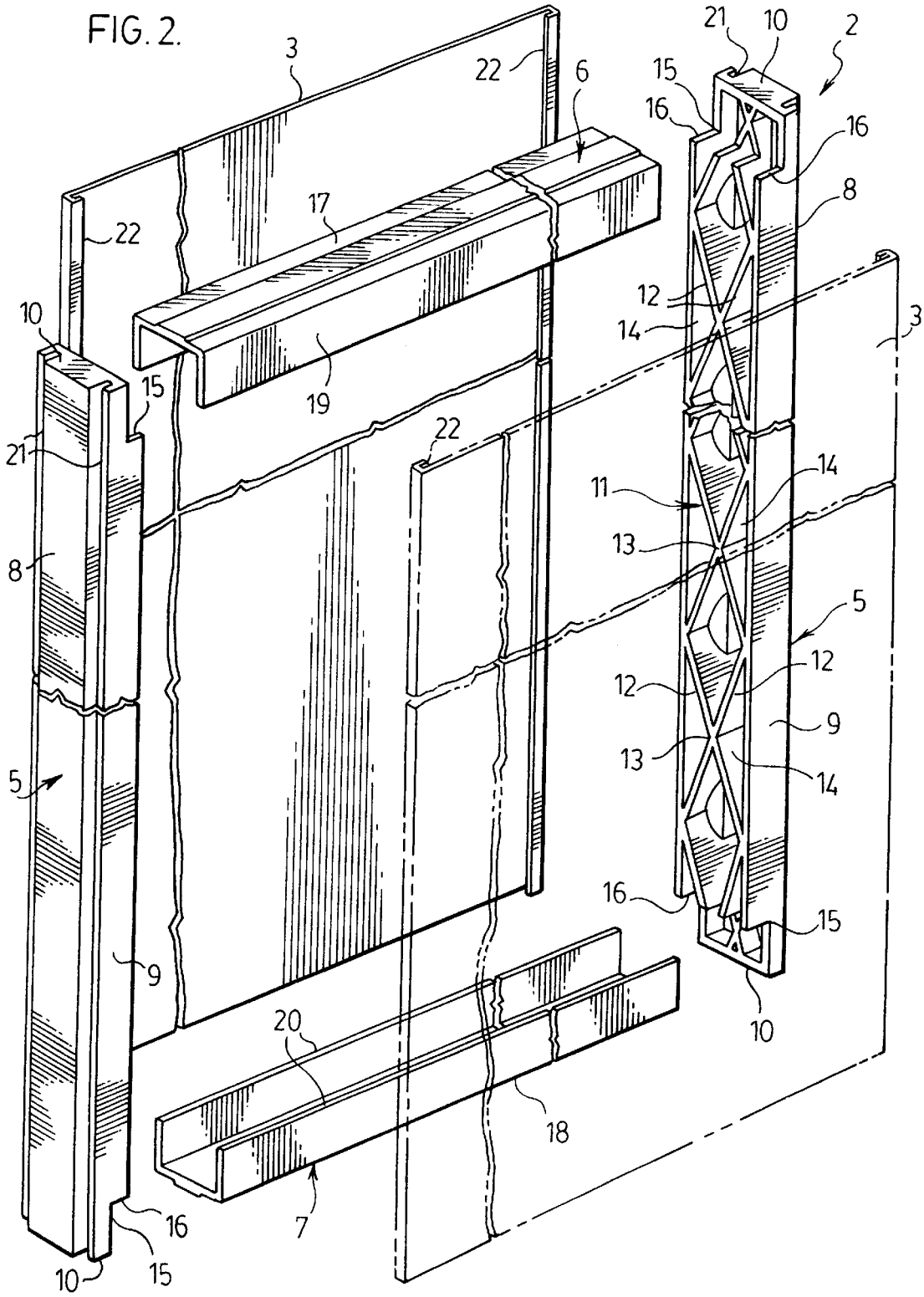
FIG. 2 is an exploded perspective view of the components of the steel clad door of FIG. 1 showing the them ready for assembly prior to filling the frame with insulation.
Figure 3:
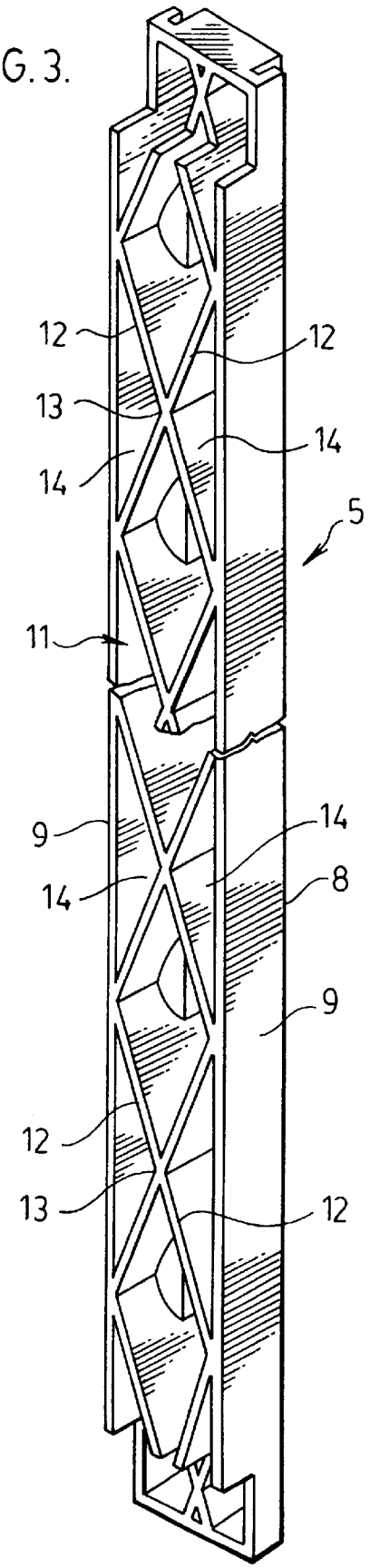
FIG. 3 is a perspective view of one of the jamb members of the cladding support frame.

With reference to FIG. 2, the frame generally designated at 2 is comprised of a pair of jamb members 5 joined by a header 6 and a sill 7.

Each of the jamb members 5 is in the form of a molded channel molded from a composite material as hereinafter more fully described, the channel having a bottom wall 8, side walls 9, and end walls 10.

The interior of the channelled jamb is formed with integral bracing extending between the side walls 9.

To provide an advantageous load distribution between the side walls 9, the bracing preferably is in the form of diagonal members 12 which have their ends formed integrally with the side walls and which intersect at a point 13 in the middle of the jamb channel to define opposing triangular formations 14.

Each end of the jamb 5 is notched as at 15 to form a support seat 16 with the seat at the top of the jamb being adapted to seat the header 6 and the seat at the bottom of the jamb to seat the sill 7.

Preferably both the header 6 and sill 7 are also formed as channels of composite material having bottom walls 17 and 18 respectively and side walls 19 and 20 respectively but without the internal bracing employed in the jambs 5.

It will be understood that in assembling the frame 2 the channel shaped jambs 5 and the channel shaped header and sill will be arranged with their bottom walls 8, 17 and 18 respectively and facing outwardly and their sidewalls 9, 19 and 20 respectively of the frame projecting inwardly of the frame.

The frame 2 may be assembled by welding the jambs and header and sill members together preparatory to adding the steel cladding panels 3.

As illustrated, the outer faces of the jamb bottom walls 8 are grooved as at 21 to receive the inturned edges 22 of the steel panels 3 thereby attaching the steel panels to the frame 2.

It will be noted that the outer faces of the side walls 9 of the jambs 5 and the outer faces of the side walls 19 and 20 of the header 6 and sill 7 form relatively wide bearing surfaces over the full height of the side walls.

After the steel cladding panels 3 have been assembled with the frame 2, the interior of the frame can be filled with insulation such as foamed urethane by introducing the material through a suitable opening (not shown) drilled through preferably one of the channels 17 or 18 which is then subsequently closed.

Figure 4:
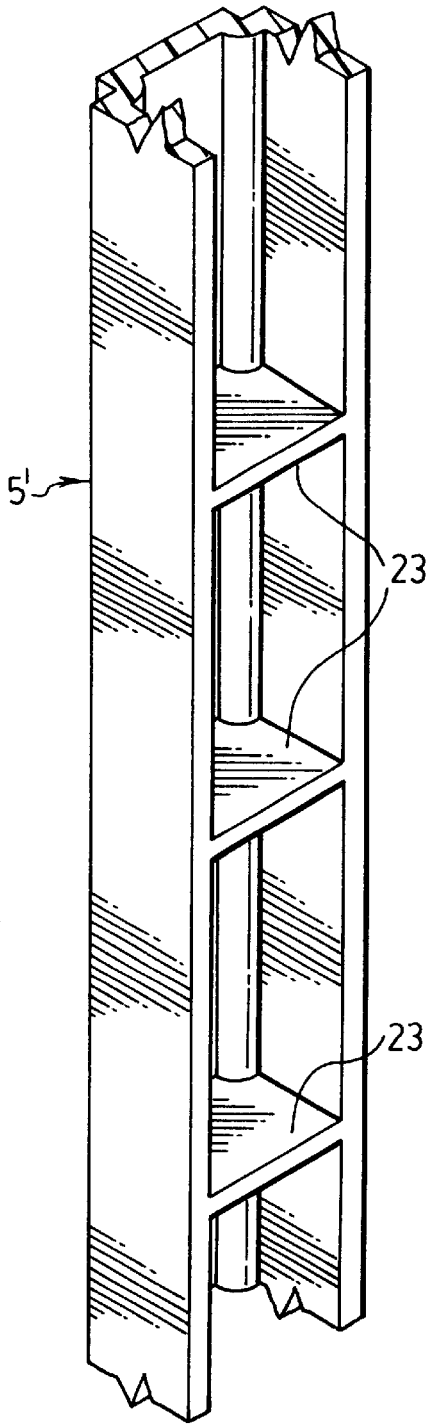
FIG. 4 is a perspective view of a jamb having an alternative form of internal bracing within the jamb channel.

FIG. 4 shows a modified form of jamb 5' which differs from the jamb 5 only in the interior bracing comprises transverse webs 23 replacing the diagonal bracing members 24 of the jamb.5.

The composite material from which the jamb members 5 and header and sill 6 and 7 respectively are formed comprise particulate material bound together with a thermoplastic binder. More particularly, according to the preferred embodiment of the invention, the composite material comprises a mixture of wood particles and waste particles bound together by a thermoplastic olefin. A particularly advantageous, low cost, highly satisfactory composition comprises approximately 30% of one or more thermoplastic olefins, 30% wood particles, and 40% waste particles. Preferably the thermoplastic olefins are recycled thermoplastics and the waste particles may include such particles as fly ash, kiln dust, sand, particles of glass, particles of rubber, metal, peanut shells, cloth etc.

By forming particularly the jamb members 5 as channels with interior integral bracing 11, a very strong structure is provided while at the same time requiring considerable less material than a corresponding solid jamb member. Further, because the side walls 9 of the jambs which serve as bearing surfaces for the steel cladding panels 3 are covered by the steel cladding, the jambs can be made of a composition containing a significant proportion of waste material without concern for the aesthetics of the surfacing of the material as only a portion of the exterior bottom of the jambs are exposed which can be readily painted or coated for aesthetic purposes.

The same remarks apply as well to the header 6 and sill 7 which again preferably are of channel form of inexpensive composite material with the bulk of the header and sill members being covered by the steel cladding 3.

It will be understood that in addition to the interlocking of the inturned edges 22 of the steel cladding panels 3 with the frame the panels may be further secured or bonded as desired to the walls 9 of the jambs or 19 and of the header and sills respectively.

Although various preferred embodiments of the present invention have been described herein in detail, it will be appreciated by those skilled in the art, that variations may be made thereto without departing from the scope of the appended claims.

The embodiments of the invention which an exclusive property or privilege is claimed are defined as follows:

1. A frame for supporting steel cladding panels of a steel clad door, said frame comprising a pair of jambs connected by a header and a sill each of said jambs comprising a molded channel of composite plastic material said channel having closed ends and an outwardly facing bottom wall and spaced steel panel bearing side walls with integral bracing extending between said sidewalls within said channel and bracing said side walls from bottom to top at spaced points along their length.

2. A frame as claimed in claim 1 in which said header and sill are formed of molded composite plastic material.

3. A frame as claimed in claim 2 in which said header and sill members are channels having their bottoms facing outwardly and their side walls forming steel panel bearing surfaces.

4. A frame as claimed in any one of claim 3 in which said composite material comprises particulate material bound together by a thermoplastic binder.

5. A frame as claimed in claim 3 in which said composite material comprises wood particles and waste particles bound together by a thermoplastic binder.

6. A frame as claimed in claim 3 in which said composite material comprises by weight approximately 30% wood particles, 40% waste particles, and 30% of at least one of thermoplastic olefin.

7. A frame as claimed in claim 1 in which the outer surfaces of the bottoms of said jambs are grooved adjacent the edges thereof.

8. A frame as claimed in claim 7 in which the ends of said jambs are closed.

9. A frame as claimed in claim 7 in which the closed ends of said jambs are notched to provide seats for said header and sill.

10. A jamb member for a frame for a steel clad door said jamb member comprising a molded channel of composite plastic material closed at the ends and having a bottom wall having an exterior surface to define a vertical door edge and spaced side walls to provide support surfaces for steel cladding, said channel having an integrally formed bracing structure extending perpendicular to said bottom wall and disposed therewithin and extending between and connected to the interior of said walls at spaced points along their length.

11. A jamb member as claimed in claim 10 in which the ends of said channel are closed by support walls bridging between said spaced side walls at the channel bottom.

12. A jamb as claimed in claim 11 in which said side walls are notched forwardly of said bridging walls to form seats for a header member at one end and a sill member at the other end.

13. A jamb as claimed in claim 12 in which said composite plastic material comprises particulate material bound together by a thermoplastic binder.

14. A jamb as claimed in claim 12 in which said composite material comprises a mixture of wood particles and waste particles bound together by a thermoplastic binder.

15. A jamb as claimed in claim 12 in which said composite material comprises by weight approximately 30% wood particles, 40% waste particles, and 30% of at least one of thermoplastic olefin.

16. A steel clad door comprising a support frame having a pair of jamb members connected by a header member and a sill member each of said jamb members comprising a molded channel of composite plastic material closed at the ends and having an outwardly facing bottom wall and spaced side walls with integral bracing within said channel extending perpendicular to said bottom wall and between and connected to said side walls at spaced points along their length, a steel cladding panel mounted on each side of said frame said panels being supported by said side walls, the interior of said door being filled with insulation material.

17. A steel clad door as claimed in claim 16 in which said header and sill members are channels formed of composite material.

18. A steel clad door as claimed in claim 17 in which the ends of said jambs are closed by a support walls bridging between said side walls at the channel bottoms and said side walls are notched forwardly of said bridging walls and said header and sill channels are seated in said notches.

19. A steel door as claimed in claim 18 in which the exterior bottoms of said channels are grooved and said steel cladding panels have their edges inturned into said grooves.

20. A steel door as claimed in claim 18 in which said composite material comprises particulate material bound together by a thermoplastic binder.

21. A steel door as claimed in claim 18 in which said composite material comprises wood particles and waste products bound together by a thermoplastic binder.

22. A steel door as claimed in claim 18 in which said composite material comprises by weight approximately 30% wood particles, 40% waste particles, and 30% of at least one thermoplastic olefin.

* * * * *